US008914923B2

(12) United States Patent
Smith

(10) Patent No.: US 8,914,923 B2
(45) Date of Patent: Dec. 23, 2014

(54) ASSEMBLIES FOR MANAGING INCONTINENCE

(76) Inventor: Dean Preston Smith, Knoxville, TN (US)

( * ) Notice: Subject to any disclaimer, the term of this patent is extended or adjusted under 35 U.S.C. 154(b) by 0 days.

(21) Appl. No.: 13/343,393

(22) Filed: Jan. 4, 2012

(65) Prior Publication Data

US 2013/0167296 A1 Jul. 4, 2013

(51) Int. Cl.
*A47G 9/00* (2006.01)

(52) U.S. Cl.
USPC ..... 5/484; 5/502; 5/699; 5/737; 5/738

(58) Field of Classification Search
USPC ..... 5/484, 502, 699, 737, 738
See application file for complete search history.

(56) References Cited

U.S. PATENT DOCUMENTS 3,812,001 A * 5/1974 Ryan ..... 428/178
4,173,046 A * 11/1979 Gallagher ..... 5/484
4,292,701 A * 10/1981 Woychick ..... 5/422
4,423,308 A * 12/1983 Callaway et al. ..... 219/217
5,371,340 A * 12/1994 Stanfield ..... 219/217
5,687,438 A * 11/1997 Biggie et al. ..... 5/654
5,881,410 A * 3/1999 Yamada ..... 5/713
6,545,253 B2 * 4/2003 Lin et al. ..... 219/528
6,596,018 B2 * 7/2003 Endo et al. ..... 607/96
6,651,278 B2 * 11/2003 Ghanem ..... 5/496
6,653,607 B2 * 11/2003 Ellis et al. ..... 219/528
6,957,454 B1 * 10/2005 Newton ..... 5/421
7,181,787 B2 * 2/2007 Wu ..... 5/421

* cited by examiner

*Primary Examiner* — Robert G Santos
*Assistant Examiner* — Duoni Pan
(74) *Attorney, Agent, or Firm* — Baumgartner Patent Law; Marc Baumgartner

(57) ABSTRACT

Bedding assemblies useful in the management of incontinence are provided herein. Preferred bedding assemblies include a top wicking layer, an electrical circuit configured to detect the presence of moisture, an absorbent layer, and a waterproof layer. Assemblies are configured to signal to a receiving device which in turn can communicate an alarm signal or be operably coupled with a notification device. Assemblies can include mattress overlays, mattress covers, and mattresses.

18 Claims, 4 Drawing Sheets

ASSEMBLIES FOR MANAGING INCONTINENCE

FIELD OF THE INVENTION

The embodiments herein relate to assemblies for managing incontinence. More particularly, the teachings herein relate to multilayer assemblies having means for detecting moisture and include a first layer that wicks away moisture in the direction of a second, more absorbent layer, and a third moisture impermeable layer.

BACKGROUND

Wetness detection sensors configured to signal with notification components are known to be placed in beds, and are useful in helping a person to control bedwetting. The sensor is typically configured to detect wetness, such as urine, and is in electronic communication with a notification component configured to emit an alarm (e.g., audio, visual, or vibratory) to alert the sleeping person or another when wetness is detected by the sensor. As one example, if the user is sleeping as they begin to urinate, the alarm will wake them up quickly so they can finish urinating in a toilet instead of in their bedding.

Prior bed sensors are disadvantageous in that they do not provide a product that can wick away the liquid from the user, is machine washable, absorbent, and is impermeable to liquids. Machine washable can relate to a product's physical qualities and/or effectiveness not being severely diminished by repeated washings in a machine clothes washer or dryings in a machine clothes dryer. Examples of physical qualities that can potentially be severely diminished include the electronic circuitry being water damaged or materials melting under the hot heat of a dryer. The prior art focuses more on correcting controllable bed wetting by waking the bed wetter so they can stop. In contrast, there is not a suitable product that can be used both to correct controllable bed wetting in addition to managing the inevitable results of incontinence. Accordingly, there is a need in the art to provide a wetness detection sensor assembly that includes the above-listed advantageous qualities. The above-listed objectives of the invention are intended to be non-limiting, as further objectives and advantages will be readily appreciated by those with skill in the art upon reading the teachings below.

SUMMARY OF THE INVENTION

According to preferred embodiments, the teachings herein generally relate to a bedding assembly for managing incontinence comprising: a top layer having a top and bottom surface and made of a material that wicks away liquid from the top surface downward to the bottom surface; an absorbent layer having a top and bottom surface and positioned below the top layer and made of a material that is more absorbent than the top layer; a waterproof layer having a top and bottom surface positioned below the absorbent layer; means for detecting the presence of liquid that is positioned in a location in the bedding assembly selected from the group consisting of: within the top layer, the bottom surface of the top layer, between the top layer and the absorbent layer, and the top surface of the absorbent layer, wherein the means for detecting the presence of liquid are configured to be in operable communication with a receiving and notification device.

BRIEF DESCRIPTION OF THE DRAWINGS

It will be appreciated that the drawings are not necessarily to scale, with emphasis instead being placed on illustrating the various aspects and features of embodiments of the invention, in which.

DETAILED DESCRIPTION OF THE ILLUSTRATED EMBODIMENTS

Embodiments of the present invention are described below with reference to the above described Figures. It is, however, expressly noted that the present invention is not limited to the embodiments depicted in the Figures, but rather the intention is that modifications that are apparent to the person skilled in the art and equivalents thereof are also included.

Figure 1:
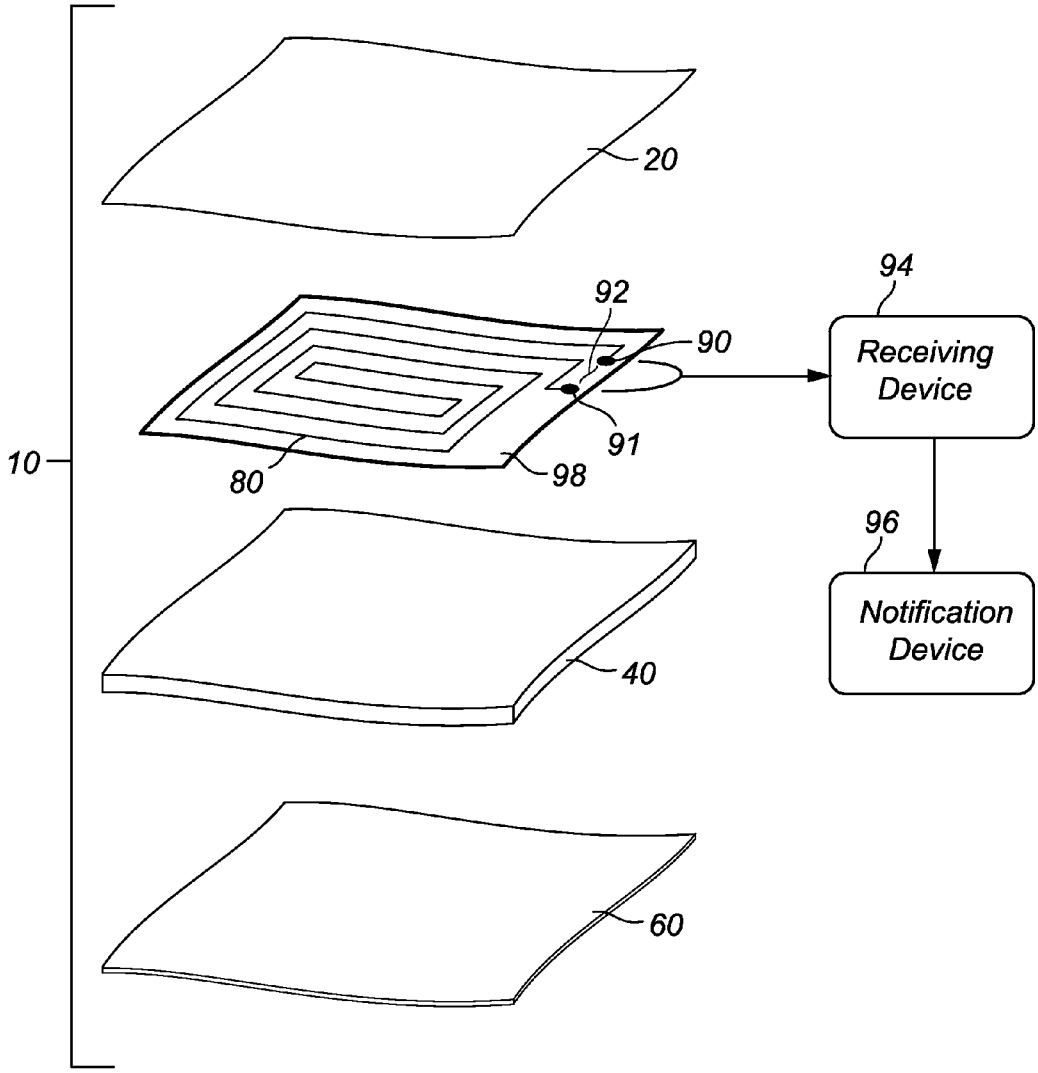
FIG. 1 is an exploded view of a preferred liquid detection assembly.

FIG. 1 is an exploded view of a preferred liquid detection assembly 10 that includes a wicking layer 20, an absorbent layer 40, and a waterproof layer 60. The top layer, or the wicking layer 20, is designed to be in contact with the sleeping person or their clothing and thus preferably includes a comfortable fabric that wicks away moisture from the sleeping person downward towards the absorbent layer 40. According to non-preferred embodiments, the top layer 20 can include cotton, but it is preferred that a wicking material, that wicks away liquid faster than cotton and dries faster than cotton, is used. Wicking, as known in the art, relates to a fabric's ability to transport moisture. Examples of non-cotton based materials can include performance synthetic fibers such as nylon, acrylic, and polyester. Other examples of the wicking layer material 20 can be fabric blends that include performance synthetic fabrics in combination with other fabrics, such as softer fabrics, including cotton, for example. It is preferred that the wicking layer 20, can transport moisture at least 2, 3, or 4 times faster than cotton from the top surface to the bottom surface. Having a quick drying material prevents stagnate moisture from pooling and causing sores to the sleeping person.

The absorbent layer 40 is positioned beneath the top layer 20 and is preferably made of a material that is more absorbent than the material of the top layer 20. Accordingly, it is preferred that the absorbent layer 40 is thicker than the top layer 20 to further enhance absorption of a bodily fluid. Preferably the absorbent layer, is not made of a wicking material such as polyester or nylon, and instead includes an absorbent fabric that is more absorbent than these materials, such as cotton. Additional absorbent fabrics and fibers that can be used include rayon, acetate, lyocell, and linen, for example. According to further embodiments, the absorbent layer can include cotton blended with another fabric, such as the absorbent materials listed above. More specifically, it is preferred that the absorbent layer can hold at least 1 times its weight in liquid, but preferably more than 5, 10, 15, or about 20 times its weight in liquid. According to non-preferred embodiments the absorbent layer can include a non-fabric, absorbent polymer positioned within a fabric. Examples of non-fabric polymers can include sodium polyacrylate, for example. Non-fabric based polymers such as sodium polyacrylate are not preferred as it prevents the assembly from being machine washable.

The assemblies 10 provided herein include a moisture detection circuit 80 that is positioned either within the top layer 20 or the absorbent layer 40 or between these two layers. According to highly non-preferred and disadvantageous embodiments, the circuit 80 can be placed in other locations within the assembly, such as on top of the top layer 20 or below the absorbent layer 40, for example. These positions, while possible, do not fully utilize the layer properties of the assembly and are thus not efficient. Preferably, the electrical circuit 80 is configured to be open when dry, and closed when in contact with a sufficient amount of a conductive liquid, such as urine or fecal matter. Liquid detecting circuitry is known in the art, and any such suitable circuitry can be used with the teachings herein. As one example, a pair of oppositely charged electrodes 90 and 91 can have a gap 92 between them where conductive matter is not present in the gap. Alternatively, the oppositely charged electrodes can be weakly connected such as to define a high resistance circuit. When a conductive liquid, such as urine enters into the area between the electrodes 90 and 91, the circuit closes, or becomes less resistant. This lowering of resistance can be communicated by means for signaling to a receiving device 94. The receiving device 94 can in turn either include means for notification or be in operable communication with one or more notification devices 96 through wired or wireless means. Notifying can include emitting an alarm, including one or more of the following signals: vibratory, visual, and audial. Alarms can be used to alert the sleeping person and/or a family member, medical personal, or another monitoring user. Notification can include multiple settings such as low auditory through high auditory alarms, or low visibility to high visibility alarms, or combinations thereof. Multiple receiving devices and notification devices can be used for a single circuit 80 if it is desired that more than one person be alerted to the presence of liquid in the bedding. A first receiving unit 94 can act as a hub in operable communication with other receiving devices and/or notification devices. Accordingly, one or more receiving devices 94 and notifying devices 96 can be located within the sleeping person's room, or in a remote location such as a parent's room, a nurse's station, or otherwise near a monitoring person.

The wetness-detection circuit 80 can be operably coupled to the receiving device 94 via wired or wireless means. According to wired means, the electrodes 90 and 91 can be operably coupled via conductive materials to be exposed externally from the assembly, whether on the top, bottom, or side to allow a wired connection to a receiving unit 94. The assemblies are preferably configured to allow for releasable attachment of wires to the receiving unit, to allow for washing. As an example, the assembly can include first and second metal snaps exposed at the topside of the top layer 20 and that pass through the top layer 20 (and potentially other layers) and are operably coupled to the electrodes 90 and 91 via conductive means. It is preferred that the conductive materials don't pass through the waterproof layer 60 to prevent urine from leaking from the assembly. If the conductive materials connecting the electrodes 90 and 91 pass through the waterproof layer, it is preferred that they do so without allowing liquid from leaking through the bottom of the waterproof layer 60. According to wireless embodiments, the change in resistance can be communicated from the circuit 80 as a wireless signal from any suitable transmitting device positioned in the assembly and to the receiving device 94. Any suitable wireless means can be used with the teachings herein, non-exclusively including Bluetooth, Wi-Fi, and RF, and the like.

In addition to electrical circuits 80, other non-electrical methods for sensing the presence of moisture or soiling could be incorporated into the assemblies 10 described herein. These could include mechanical or chemical means for detection, and non-exclusively include scales, or means for sensing a weight gain on the bedding, for example. While the description herein is primarily directed to electrical circuits 80, alternative means for sensing liquid can readily be substituted in the description pertaining to circuits 80 where applicable.

According to certain embodiments, the circuit 80 can be directly integrated into the top layer 20 or to the absorbent layer 40. More specifically it is preferred that the circuit 80 be attached to the underside of the top layer 20 or the topside of the absorbent layer 40. Any suitable means for attaching the circuit 80 to the top layer 20 or the absorbent layer 40 can be used herein, non-exclusively including gluing, taping, and sewing, for example. Further embodiments include the direct incorporation of the circuit 80 into either the top layer 20 or the absorbent layer 40. The circuit 80 can include any suitable conductive materials such as wires, thread, yarn, tape, paint, and fabric. According to preferred embodiments, the conductive material of the circuit 80 is a metallic yarn, such as stainless steel yarn. Stainless steel yarn allows flexibility, and has good heat tolerance which is beneficial for washing and drying. According to further embodiments, the circuit 80 can be integrated with a circuitry layer 98 other than the top layer 20 or the absorbent layer 40, and positioned between said top layer 20 and the absorbent layer 40. When the circuit 80 is integrated with a separate layer 98, it is preferred that this layer is made of the same or similar material such as those disclosed for the top layer 20, described above, such that liquid is wicked downward into the absorbent layer 40 below. According to non-preferred embodiments, the assemblies herein can be made to be disposable, such that the circuit 80 is configured to be releasably removable from the assembly. Under this embodiment, the circuit 80 can be removed and inserted into the assembly via a pocket or flap and saved, while the remaining assembly can be disposed of. While possible, the teachings herein are mainly directed to a washable, non-disposable assembly.

A waterproof layer 60 is positioned below the absorbent layer 40. The waterproof layer 60 comprises a material that is impermeable to urine and liquid to prevent liquid from flowing through it and onto the surrounding bedding. Any suitable waterproofing material can be used for this layer, such as polyurethane, PVC, and the like.

Figure 2:
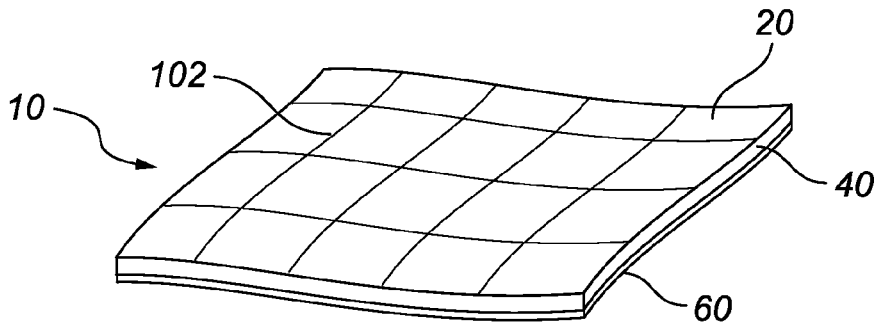
FIG. 2 is an assembled liquid detection assembly, such as a mattress overlay.

The above-described three layers (top layer 20, absorbent layer 40, and waterproof layer 60) in addition to the circuit 80, and optional circuitry layer 98 can be coupled together in any suitable way. According to more specific embodiments the top layer 20 and the absorbent layer 40 along with the electrical circuit 80 are quilted together with needle and thread by hand or machine. If used, the optional circuitry layer 98 can also be quilted in between the top layer 20 and the absorbent layer 40 as well. Using an adhesive between the wicking layer 20 and the absorbent layer 60 is not desirable as it could prevent or hinder the flow of urine to the circuit 80. Quilting can be done in multiple crisscrossing rows and columns as shown in FIG. 2 if desired to secure the layers together. If quilting is used to couple the top layer 20 and the absorbent layer 40 together it is preferred that the waterproof layer 60 is not quilted because the holes from the needle could cause liquid to permeate through the bottom layer 60 and into the surrounding bedding. If the waterproof layer 60 is sewn to the top layers (20 and 40) it would be preferably done only near the outer perimeter of the waterproof layer 60 to minimize holes in the waterproof layer 60, especially near the center of the waterproof layer. Preferably, the waterproof layer 60 is coupled to the underside of the absorbent layer 40 by other means, such as snaps, hook and loop fasteners, glue or other adhesives.

Figure 3:
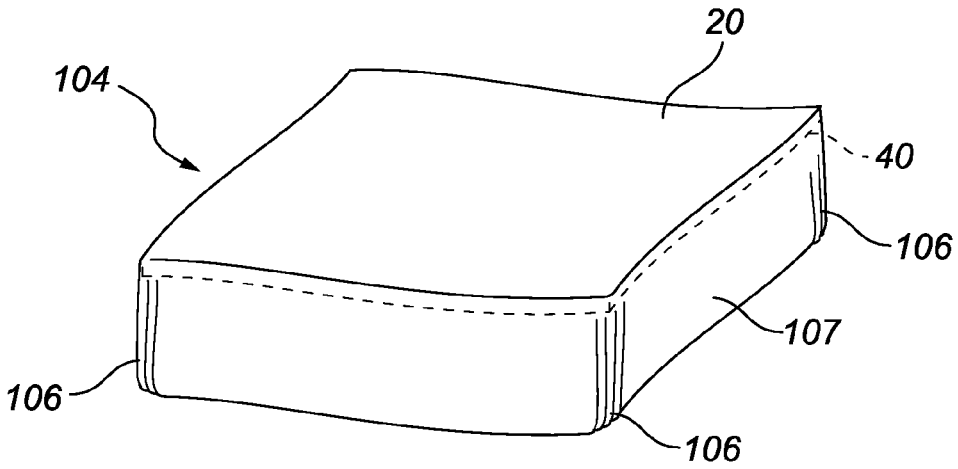
FIG. 3 is a liquid detection assembly in the shape of a fitted sheet.

The assemblies herein can in general be configured to be one of three products: 1) mattress overlays, 2) mattress covers, and 3) mattresses. Overlays can be one of various sizes of pads that can cover a portion of a mattress. FIG. 2 shows an example of an overlay 10. Small overlays may be a 1-2 square feet in surface area, as an example, while larger overlays may cover the entire top surface, or nearly the entire top surface of the mattress (e.g., ¾ the size of the mattress), regardless of the size, such as a twin, double, queen, king, or California king size, for example. Overlays may or may not include material that can be tucked into the underside of the mattress, such as in the shape of a flat sheet. As one example, fabric can be sewn, or otherwise attached, to the wicking layer 20 to form "tucking wings" that can be tucked underneath a mattress to prevent the overlay 10 from moving around. Mattress covers 104 such as shown in FIG. 3 are also known as fitted sheets can also be used as assemblies. According to these embodiments, a skirt 107 can be sewn or otherwise attached such that it extends from the sides of the wicking layer 20. The skirt 107 can be made of the same material as the wicking layer 20 or another suitable type of fabric. More specifically, the corners of the skirt 107 can include elastic material 106 that allows for flexible fastening of the mattress cover onto the mattress's corners. Elastic material can be coupled to the skirt 107 using any suitable means, such as adhesives, sewing and the like.

Figure 4:
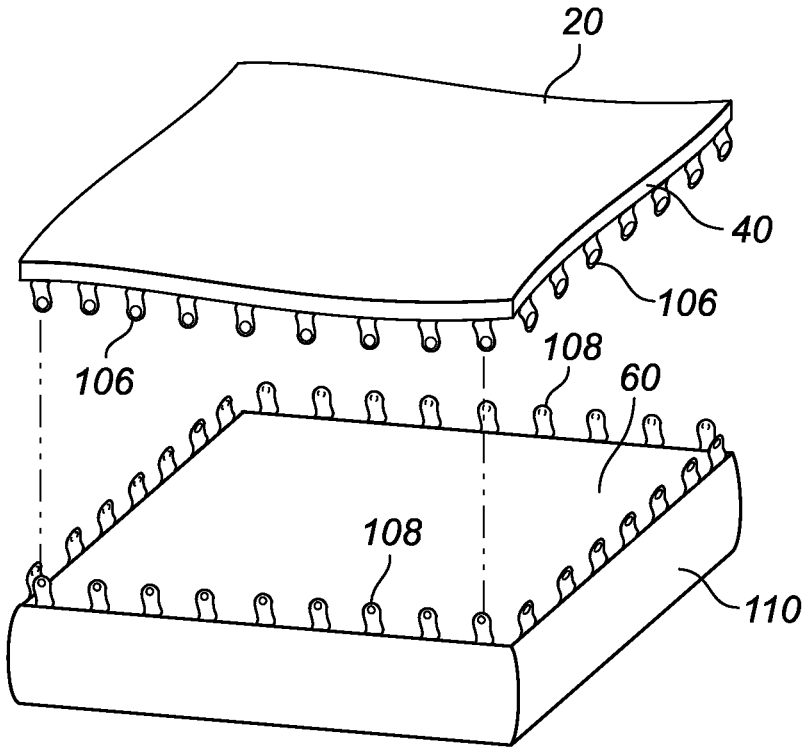
FIG. 4 is a liquid detection assembly that is a mattress.

Different embodiments are disclosed for assemblies that are mattresses. With respect to FIG. 4 the mattress 110 can comprise a top surface which is the waterproof layer 60. The coupled wicking layer 20 and absorbent layer 40, in addition to the circuit 80, and optional circuitry layer 98, are preferably configured to be releasably attached to the waterproof layer 60. This can be done using any suitable means, such as complementary releasable fasteners (106 and 108) on the side or underside of the absorbent layer 40 and the topside of the waterproof layer 60 or side of the mattress 110. These fasteners can include snaps, buttons, hook and loop fasteners, such as VELCRO®, or zippers, for example. The wicking layer 20 and the absorbent layer 40 would thus be readily detachable from the waterproof layer 60 for easy washing and drying in a washing machine and dryer. Additionally, releasable fasteners can be placed on the wicking layer 60, or extensions thereof, and be configured to couple with releasable fasteners on the side or on top of the mattress.

Figure 5:
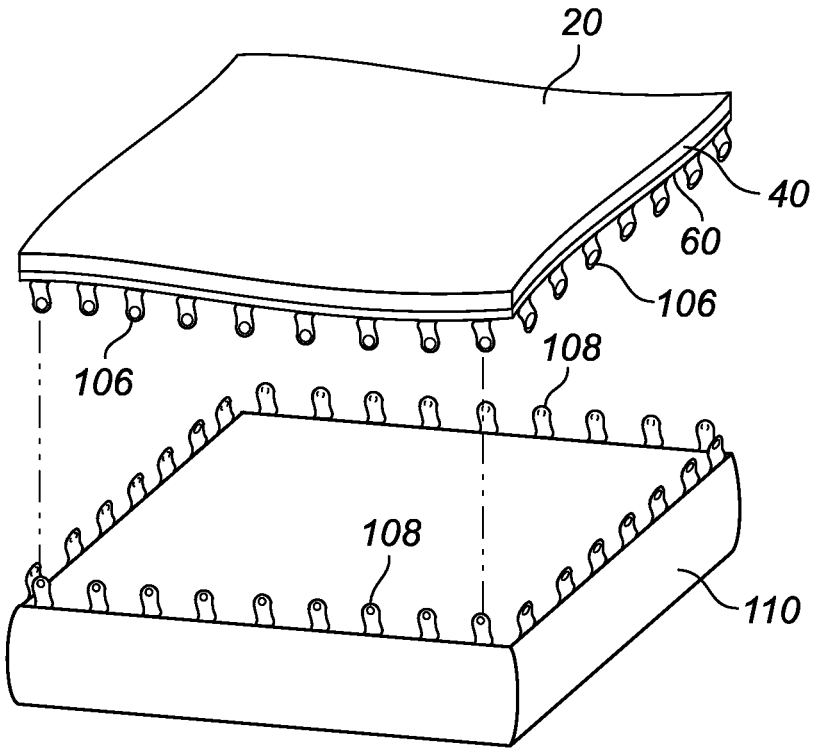
FIG. 5 is a liquid detection assembly that is an alternative embodiment of a mattress.

A second embodiment of mattress assembly is disclosed in FIG. 5. In this embodiment, the wicking layer 20 and absorbent layer 40 are non-releasably attached to the waterproof layer 60 to form a single assembly that is releasably attachable to the mattress 110 for easy washing and drying in a washing machine and dryer. Complementary fasteners, as described in the above-paragraph, can be placed on the underside of the waterproof layer 60, absorbent layer 40, or wicking layer 20, or extensions thereof, and be configured to couple to topside or sides of the mattress 110.

Preferred assemblies herein are configured to be machine washable and machine dryable on high heat in their entireties. Thus materials should be flexible, and be heat and water resistant. Assemblies herein can include instructions, such as on tags or separate manuals, for machine washing and/or drying the assembly. For mattresses assemblies, the mattress itself would not be washable in a machine washer and dryer, but the removable top layers of the wicking layer 20, the absorbent layer 40, electrical circuit 80, and optional circuitry layer 98 or waterproof layer 60 would be. Additional advantages of the assemblies described herein is that they are capable of containing bodily fluids entirely in the assembly without allowing leakage to surrounding bedding such as top sheets, pillows, and the floor.

The invention may be embodied in other specific forms besides and beyond those described herein. The foregoing embodiments are therefore to be considered in all respects illustrative rather than limiting, and the scope of the invention is defined and limited only by the appended claims and their equivalents, rather than by the foregoing description.

What is claimed is:

1. A bedding assembly for managing incontinence comprising:

a top layer having a top and bottom surface and made of a material that wicks away liquid from the top surface downward to the bottom surface;

an absorbent layer having a top and bottom surface and positioned directly below the top layer and made of a material that is more absorbent than the top layer;

a waterproof layer having a top and bottom surface positioned below the absorbent layer;

a liquid sensor that is positioned in a location in the bedding assembly selected from the group consisting of: within the top layer, the bottom surface of the top layer, between the top layer and the absorbent layer, and the top surface of the absorbent layer, wherein the liquid sensor is configured to be in operable communication with a receiving and notification device wherein the top layer and the absorbent layer in addition to the liquid sensor are quilted together with thread in multiple rows and columns and wherein the liquid sensor is an electrical circuit made of metallic yarn or thread and is configured to detect a change in electrical resistance when a conductive liquid is present in the circuit and wherein the electrical circuit is configured to emit an electronic signal to the receiving device when the conductive liquid is detected.

2. The bedding assembly of claim 1, wherein the metallic yarn or thread is made of stainless steel.

3. The bedding assembly of claim 1 wherein neither the electrical circuit's nor the bedding assembly's effectiveness is significantly diminished by repeated washing in a machine washer or drying in a machine dryer.

4. The bedding assembly of claim 3, further comprising instructions for machine washing the bedding assembly.

5. The bedding assembly of claim 1, wherein the receiving and notification devices are the same device.

6. The bedding assembly of claim 1, wherein the waterproof layer is coupled to the absorbent layer without the use of quilting.

7. The bedding assembly of claim 6, wherein the waterproof layer is coupled to the absorbent layer by stitching near the outer perimeter of the waterproof layer, such that stitching does not go through the central area of the waterproof layer.

8. The bedding assembly of claim 6, wherein the waterproof layer is glued to the bottom of the absorbent layer.

9. The bedding assembly of claim 1, wherein the topside of the waterproof layer includes a first set of releasable fasteners that are configured to couple to second set of releasable fasteners positioned on the underside of the absorbent layer, and wherein the waterproof layer defines a non-releasable topside of a mattress.

10. The bedding assembly of claim 1, wherein the wicking layer, absorbent layer, liquid sensor, and the waterproof layer are non-releasably attached to each other and wherein the bedding assembly includes a first set of releasable fasteners, and further comprises a mattress having a top surface and a second set of releasable fasteners complementary to the first releasable fasteners such that when said complementary first and second sets of releasable fasteners are coupled together the bottom surface of the waterproof layer is positioned flat on the top surface of the mattress.

11. The bedding assembly of claim 1, further comprising additional fabric coupled to and extending away from the perimeter of the top layer, of a different material than the top layer, to define flaps or a skirt that can be used to secure the bedding assembly underneath a mattress.

12. The bedding assembly of claim 1, wherein the top layer extends past the perimeters of the absorbent and waterproof layers to define flaps or a skirt that can be used to secure the bedding assembly underneath a mattress.

13. The bedding assembly of claim 1, wherein the liquid sensor is positioned on a separate fourth layer having a top and bottom surface positioned between the top layer and the absorbent layer, wherein the fourth layer is made of a material that wicks away liquid from the top surface downward to the bottom surface.

14. The bedding assembly of claim 13, wherein the fourth layer is quilted to the top layer and the absorbent layer with thread in multiple rows and columns and the waterproof layer is coupled to the absorbent layer without the use of quilting.

15. A bedding assembly for managing incontinence comprising:

a top layer having a top and bottom surface and made of a material that wicks away liquid from the top surface downward to the bottom surface;

an absorbent layer having a top and bottom surface and positioned directly below the top layer and made of a material that is more absorbent than the top layer;

a waterproof layer having a top and bottom surface positioned below the absorbent layer;

a liquid sensor that is positioned in a location in the bedding assembly selected from the group consisting of: the bottom surface of the top layer, between the top layer and the absorbent layer, and the top surface of the absorbent layer, wherein the liquid sensor is an electrical circuit made of metallic yarn or thread and is configured to detect a change in electrical resistance when a conductive liquid is present in the circuit, and wherein the liquid sensor is configured to be in operable communication with a receiving and notification device.

16. The bedding assembly of claim 15, wherein the top layer and the absorbent layer in addition to the liquid sensor are quilted together with thread in multiple rows and columns.

17. The bedding assembly of claim 16, wherein the waterproof layer is coupled to the absorbent layer without the use of quilting.

18. The bedding assembly of claim 16, wherein the waterproof layer is coupled to the absorbent layer by stitching near the outer perimeter of the waterproof layer, such that stitching does not go through the central area of the waterproof layer.

* * * * *